US012276055B2

(12) United States Patent
Dilo et al.

(10) Patent No.: US 12,276,055 B2
(45) Date of Patent: Apr. 15, 2025

(54) NEEDLE MACHINE AND METHOD FOR EQUIPPING AND OPERATING A NEEDLE MACHINE

(71) Applicant: Oskar Dilo Maschinenfabrik KG, Eberbach (DE)

(72) Inventors: Johann Philipp Dilo, Eberbach (DE); Niklas Kappes, Eberbach (DE)

(73) Assignee: Oskar Dilo Maschinenfabrik KG, Eberbach (DE)

( * ) Notice: Subject to any disclaimer, the term of this patent is extended or adjusted under 35 U.S.C. 154(b) by 17 days.

(21) Appl. No.: 18/532,067

(22) Filed: Dec. 7, 2023

(65) Prior Publication Data

US 2024/0191412 A1 Jun. 13, 2024

(30) Foreign Application Priority Data

Dec. 8, 2022 (EP) ..... 22 212 187

(51) Int. Cl.
*D04H 18/02* (2012.01)

(52) U.S. Cl.
CPC ..... *D04H 18/02* (2013.01)

(58) Field of Classification Search
CPC ..... D04H 18/02; D04H 18/00; D04H 1/46; D04H 3/102; D04H 3/105; D04H 13/005; D04H 5/02
USPC ..... 28/115, 107–114
See application file for complete search history.

(56) References Cited

U.S. PATENT DOCUMENTS

| | | | | |
|---|---|---|---|---|
| 5,858,890 | A * | 1/1999 | Sheehan | F16D 69/023 442/388 |
| 6,161,269 | A * | 12/2000 | Dilo | D04H 18/02 28/107 |
| 6,360,412 | B1 * | 3/2002 | Duval | D04H 18/02 28/107 |
| 11,384,460 | B2 * | 7/2022 | Dilo | D04H 18/02 |
| 2014/0310928 | A1 * | 10/2014 | Kuhl | D04H 18/02 28/110 |
| 2018/0274144 | A1 * | 9/2018 | Evrard | D04H 1/46 |
| 2021/0332515 | A1 * | 10/2021 | Demange | D04H 18/02 |

FOREIGN PATENT DOCUMENTS

| | | | |
|---|---|---|---|
| CN | 116121959 | A * | 5/2023 |
| CN | 118814367 | A * | 10/2024 |
| EP | 3 896 207 | A1 | 10/2021 |
| GB | 1 308 999 | A | 3/1973 |
| KR | 101935743 | B1 * | 1/2019 |

OTHER PUBLICATIONS

EP 22 21 2187 Search Report dated May 31, 2023. 5 pages.

* cited by examiner

*Primary Examiner* — Amy Vanatta
(74) *Attorney, Agent, or Firm* — Jansson Munger & McKinley Ltd.

(57) ABSTRACT

A needle machine has a needle bar having a plurality of needles, a holding-down device for holding-down a textile fabric structure, and a support device for supporting the textile fabric structure. A monitoring device is configured to monitor the positioning of the plurality of needles relative to the holding-down device or to the support device.

17 Claims, 5 Drawing Sheets

NEEDLE MACHINE AND METHOD FOR EQUIPPING AND OPERATING A NEEDLE MACHINE

FIELD OF THE INVENTION

The present invention relates to a needle machine for needling a textile fabric structure, such as a fibrous web, a non-woven fabric, a web or mat. The present invention further relates to a method for equipping and a method for operating a needle machine.

BACKGROUND OF THE INVENTION

Needle machines are generally known in the art. Generally, a textile fabric structure, such as a fibrous web, a non-woven fabric, a web or mat, is supplied to an inlet and conveyed in the needle machine in a conveying direction to a needling zone. In the region of the needling zone, there is arranged at least one needle bar which has a needle board which is secured thereto and which is provided with a plurality of needles for compacting the textile fabric structure. The needles compress the textile fabric structure by being inserted at a high frequency into the textile fabric structure in a needling direction and removed from it again. Extremely varied forms of needle machines are known to the person skilled in the art, also including double needle machines, in which the needling is carried out from the top and bottom by two needle bars, or needle machines in which the needle bar is also moved in the conveying direction of the textile fabric structure during the compacting operation.

Attempts have been made to increase the density of the needles and consequently the needling of the textile fabric structure in order to optimize the properties of the compacted non-woven material. However, this compaction of the needles is limited as a result of shape and positional tolerances in the production and assembly of the needles, the needle boards, holding-down and needle plates and the resultant, increased risk of collision between the needles and the holding-down or needle plates. In the event of a collision, the needles could break, which in many applications represents an unacceptable risk. In addition, a contact of the rapidly moving needles with respect to the holding-down plates and needle plates may lead to increased wear.

SUMMARY OF THE INVENTION

It is an object of the present invention to provide a needle machine and a method for equipping and a method for operating a needle machine which enable a high level of operational reliability and at the same time a high needle density.

According to an aspect of the invention, a needle machine for needling a textile fabric structure comprises a needle bar having a plurality of needles for consolidating the textile fabric structure in a needling zone of the needle machine, a holding-down device for holding-down the textile fabric structure in the needling zone, wherein the holding-down device has a plurality of through-openings for the plurality of needles, and a support device for supporting the textile fabric structure in the needling zone, wherein the support device has a plurality of through-openings for the plurality of needles. A monitoring device is configured to monitor the positioning of the plurality of needles relative to the holding-down device and/or to the support device.

In this manner, there is provided a needle machine in which the positioning of the plurality of needles relative to the holding-down device and/or to the support device can be monitored, whereby, even with a high needle density, an incorrect positioning of one or more needles can be identified and overcome. An incorrect positioning of needles could, during operation of the needle machine, lead to a contact of these needles with the needle holding-down and/or the support device which in turn can result in increased wear or even needle breakage or wire breakage. The risk increases with increasing needle density. By the monitoring device, this can be counteracted and the operational reliability can be increased.

Generally, in the context of the invention, a "holding-down device and/or support device" is intended to be understood to refer only to the needle holding-down device when the monitoring device is configured for monitoring the positioning of the plurality of needles relative to the needle holding-down device, or to refer only to the support device when the monitoring device is configured to monitor the positioning of the plurality of needles only relative to the support device, or to refer to the needle holding-down device and the support device when the monitoring device is configured to monitor the positioning of the plurality of needles relative to the needle-holding-down device and the support device.

Between the needle holding-down device and the support device, an intermediate space for the passage of the textile fabric structure is preferably formed by the needling zone. The textile fabric structure extends through the needling zone in a conveying direction and is received in the needling zone between the holding-down device and the support device. Preferably, the holding-down device and the support device are therefore arranged one above the other in a direction perpendicular to the conveying direction.

The needling zone extends in all embodiments in a conveying direction preferably over a range from 20 cm to 200 cm, more preferably 25 cm to 100 cm. The needling zone extends in all embodiments transversely relative to the conveying direction, preferably over a range from 200 cm to 500 cm, more preferably 250 cm to 400 cm.

The needle bar may carry out an oscillating stroke movement which has at least one component in a needling direction perpendicular to the conveying direction. The plurality of needles can thereby be inserted into the textile fabric structure and be pulled out of it again. It is also conceivable for the plurality of needles to have a movement component in the conveying direction so that the needles are moved with the textile fabric structure in the conveying direction whilst they are in engagement with the textile fabric structure. As a result of the superimposition of the oscillating stroke movement in the needling direction and the movement in the conveying direction, the needle tips of the plurality of needles may describe an elliptical or circular movement path.

The needle machine may in principle also have more than one needle bar, wherein the needle bars may be arranged in known manner in the conveying direction one after the other and/or transversely relative to the conveying direction and transversely relative to the needling direction. The features described herein apply in a similar manner to a plurality of needle bars.

In order to drive the needle bar, the needle machine may comprise a drive apparatus which is configured to move the at least one needle bar at least in an oscillating stroke movement. For example, the drive apparatus comprises a drive shaft on which there is eccentrically supported a connecting rod which in turn is connected to the at least one needle bar, in particular in an articulated manner.

So that the plurality of needles can penetrate into the textile fabric structure, generally at least the holding-down device has through-openings for the needles. Furthermore, the support device also has through-openings for the needles, for example, when the plurality of needles are intended to penetrate through the textile fabric structure or the textile fabric structure is needled from above and from below. Of course, with increasing needle density, the free space of the plurality of needles in the through-openings is reduced and the risk of a contact of the needles with the holding-down device and/or with the support device thereby increases.

The monitoring of the positioning of the plurality of needles relative to the holding-down device and/or to the support device may involve the determination of the position of the plurality of needles relative to the holding-down device and/or to the support device. However, it may be sufficient to determine whether the plurality of needles has a positioning which is correct or which is not correct. For example, the positioning of each needle may be correct as long as the needle passes through the through-openings in the holding-down device and/or in the support device and not correct as soon as the needle contacts the holding-down device and/or the support device. The determination of a precise position of each needle is not required for this purpose so that the monitoring device can be constructed in a simple manner. Particularly relevant is in principle a positioning of the plurality of needles in a transverse direction perpendicular to the conveying direction and perpendicular to the penetration direction since generally in this instance the least free space is available.

In one embodiment, the monitoring device may be configured to detect an approach of a needle of the plurality of needles toward the holding-down device and/or the support device. In this manner, it is already possible to react promptly to an approach of a needle to the holding-down device and/or the support device before contact can even occur. The approach can be determined by a reduction of the spacing of a needle from the holding-down device and/or support device or by a spacing of a needle from a predetermined position or a deviation from this predetermined position. Particularly relevant in this instance is again an approach in a transverse direction.

In a preferred embodiment, the monitoring device is configured to detect a contact between a needle of the plurality of needles and the holding-down device and/or support device. A contact between a needle of the plurality of needles and the holding-down device and/or the support device can be detected in a relatively simple and reliable manner so that the monitoring device can be implemented in a simple and cost-effective manner with a reliable operating method.

Preferably, the monitoring device is configured to output an optical and/or an acoustic and/or an electrical signal when a needle from the plurality of needles comes into contact with the holding-down device and/or the support device. The electrical signal may be an analogue or digital signal which can, for example, be transmitted to a control unit. An operator of the needle machine can thereby be reliably informed of the contact in order to take corresponding measures.

It is also conceivable that, in the event of contact, the needle machine to be stopped, in particular a stroke movement of the needle bar to be stopped, for example, by actuating an emergency stop. Consequently, the monitoring device is then configured to bring about a stop of the needle machine.

The monitoring device may be an optical monitoring device which, for example, comprises at least one camera, photoelectric barrier, laser or the like. An optical monitoring device is suitable particularly for detecting a needle which is arranged in an undesirable region or which is leaving it.

Additionally or alternatively, the monitoring device may be an acoustic monitoring device which comprises, for example, a sound converter, such as a microphone. In the event of contact of a needle with the holding-down device and/or with the support device, sound waves which can be detected are produced. In particular, a frequency can be detected. Furthermore, the monitoring device may additionally or alternatively comprise a vibration monitoring device. In the event of contact of a needle with the holding-device and/or with the support device, the holding-device and/or the support device is caused to at least partially vibrate, which can be detected.

In a particularly preferred embodiment, the monitoring device is an electrical monitoring device which comprises, for example, a resistance detection device, a conductive detection device, an inductive detection device or a capacitive detection device. The electrical monitoring device preferably uses low voltage, in particular a voltage of a maximum of 25 V, more preferably a maximum of 10 V. The monitoring device is thereby as far as possible harmless for the operator. In one embodiment, the holding-down device and/or the support device may be acted on with a digitally encoded signal and the monitoring device is configured to evaluate the signal. For example, the signal may be characteristic for a specific element or a specific portion of the holding-down and/or the support device.

A conductive detection device and a resistance detection device are particularly suitable for detecting a contact of a needle of the plurality of needles with the holding-down device and/or with the support device. An inductive or capacitive detection device is particularly suitable for detecting an approach of a needle of the plurality of needles to the holding-down device and/or to the support device.

The electrical monitoring device is preferably constructed in such a manner that, when one needle of the plurality of needles comes into contact with the holding-down device and/or with the support device, a power circuit comprising a voltage source is closed. The plurality of needles and the holding-down device and/or the support device are to this end constructed to be at least partially electrically conductive. In this manner, when a needle comes into contact with the holding-down device and/or with the support device, an electrical signal which can be used or digitally encoded, for example, for the optical and/or acoustic signal is produced.

In a first embodiment, each of the needles of the plurality of needles is connected to an earth or the voltage source, in particular to the minus pole of the voltage source, in an electrically conductive manner. In addition, the holding-down device and/or the support device may be connected to the voltage source in an electrically conductive manner. If a needle of the plurality of needles then contacts the device of the holding-down device and/or of the support device which is connected to the voltage source, the power circuit is closed and an electrical current flows. However, it is also conceivable, for example, for only one needle of a group of needles, for example, the needles of one needle module, to be connected to the voltage source. Thus, using one needle, an incorrect position of the entire group can be concluded.

In the first embodiment, each needle can be connected individually to the voltage source. To this end, the individual needles would have to be supported in a state electrically insulated from each other in the needle board and individually connected to the voltage source, which is possible, for example, by strip conductors. Preferably, however, groups of needles of the plurality of needles are connected to a common electrically conductive contact element which in turn is connected to the voltage source in an electrically conductive manner. Each group of needles comprises a plurality of needles. The complexity and required structural space can thereby be reduced.

For example, each needle of the plurality of needles has a tip and a head which is opposite the tip. On the needle bar or the needle board at least one electrically conductive contact element is provided and the plurality of needles are fitted to the needle bar or needle board in such a manner that the heads of the needles are in contact with the at least one conductive contact element.

Generally, the needles are preferably arranged in needle modules, wherein each needle module has a module carrier and a plurality of needles. The plurality of needles is connected in a head-side portion to the module carrier, for example, by injection-molding, so that the tips of the plurality of needles protrude in one direction from the module carrier. The module carrier is preferably formed from a non-conductor, in particular from plastics material. Each needle module may have a single longitudinal row of needles or a plurality of longitudinal rows of needles. In order to enable an electrical contacting, the heads of the plurality of needles are also preferably exposed or protrude from the module carrier, which is particularly relevant for the first embodiment of the monitoring device.

The needle modules can in turn be received in recesses or carriers of at least one needle board and secured at that location. Preferably, in this instance, a plurality of needle modules are arranged one behind the other in the transverse direction, wherein the rows of needles of the needle modules are orientated in a conveying direction. The needle modules may be displaceable in the recesses or carriers and securable in the desired position, for example, clamped. Each needle board is in turn secured to the needle bar. In the first embodiment of the monitoring device, the at least one electrically conductive contact element can be inserted into the recesses or the carrier of the needle board or can be constructed integrally therewith so that it is in contact with the needles of inserted needle modules.

The arrangement of the needles in needle modules has several advantages. The needle modules may be arranged displaceably in the needle board, whereby the stitch pattern and the needle board equipment can be configured in a variable manner. Furthermore, the needle modules can consequently be orientated relative to the holding-down device and to the support device in order to avoid contact therewith. Furthermore, the needle modules may be arranged so close to each other that no intermediate space remains between individual needle modules.

In a second embodiment, the holding-down device and the support device are constructed in an at least partially electrically conductive manner and are connected to the voltage source in an electrically conductive manner. Each needle is preferably constructed in an electrically conductive manner. The plurality of needles does not in this instance have to be connected separately to the earth or the voltage source. Instead, a needle which contacts the holding-down device and the support device closes the power circuit and an electric current flows. An electrical contacting of the holding-down device and the support device with the voltage source can generally be implemented more easily and in a more reliable manner than a contacting of the plurality of needles.

In order to enable a high needle density, it is preferable for the holding-down device and the support device independently of each other to comprise a plurality of wires for holding down or supporting the textile fabric structure. The needles of the plurality of needles can thereby be arranged with a small spacing with respect to each other whilst the wires can extend through between the needles in order to perform their holding-down or support function. To this end, it is further advantageous for the plurality of wires of the holding-down device to be arranged in the needling zone in a plane which is formed parallel with the conveying direction and the transverse direction. In a further advantageous manner, the plurality of wires of the support device is arranged in the needling zone in a plane which is formed parallel with the conveying direction and the transverse direction or parallel with the plane of the plurality of wires of the holding-down device. Between the wires of the holding-down device, through-openings for the plurality of needles are formed and, between the wires of the support device, through-openings for the plurality of needles are also formed.

In order to achieve the simplest construction possible, the wires of the plurality of wires are preferably stored in such a manner that they are non-movable in the conveying direction of the needle machine. For example, each wire has two ends which are secured in the needle machine. During operation of the needle machine, the plurality of wires are preferably arranged in a stationary manner.

In order to form the electrical monitoring device, each wire of the plurality of wires of the holding-down device and/or of the support device can be connected to a voltage source, as described above. In this instance, it may involve one and the same voltage source for all wires of the holding-down device and the support device, a voltage source for the wires of the holding-down device and for the wires of the support device, or a plurality of voltage sources for a group of wires of the holding-down device and/or the support device.

In all embodiments, the wires are preferably constructed in an electrically conductive manner, preferably as metal wires. The wires may be tensioned in such a manner that they are electrically insulated from each other.

The plurality of wires are preferably arranged parallel with each other and parallel with the conveying direction of the needle machine in the needling zone and spaced apart from each other in a transverse direction. Consequently, between two adjacent wires a through-opening for the needles is formed in each case. As a result of the orientation of the wires parallel with the conveying direction, the through-openings also extend parallel with the conveying direction so that a movement component in the conveying direction is enabled for the plurality of needles. However, the plurality of wires may also be orientated obliquely with respect to the conveying direction.

During an oscillating movement of the plurality of needles, the needles extend in each case between two adjacent wires of the plurality of wires. In other words, in a lowered state of the plurality of needles, each needle is arranged in a through-opening between two wires.

In a preferred embodiment, the needles are arranged in rows, for example, in the above-described needle modules, wherein the rows of needles are orientated parallel with an extent direction of the plurality of wires. Preferably, each row of needles is then introduced between two adjacent wires of the plurality of wires. The pitch of the rows of needles preferably corresponds to the pitch of the plurality of wires. For example, however, it would also be conceivable to omit individual needle rows or modules.

In all embodiments, a pitch of the plurality of wires is preferably between 1.4 mm and 4 mm, more preferably between 1.8 mm and 3.2 mm, even more preferably between 2.2 mm and 2.8 mm.

Preferably, the plurality of wires has a diameter between 0.4 mm and 2 mm, preferably between 0.5 mm and 1.5 mm, more preferably between 0.6 mm and 1.2 mm. The small diameters of the wires promote a high needle density, consequently a particularly narrow stitch pattern and a particularly uniform compacted end product.

In a preferred embodiment, the needles are arranged in a density of at least 500 needles/$dm^2$, preferably at least 1000 needles/$dm^2$, more preferably at least 1500 needles/$dm^2$. Such high needle densities lead to a particularly uniform stitch pattern in the compacted end product.

On the needle head, the plurality of needles have a diameter which is preferably between 1.0 mm and 2.0 mm, more preferably between 1.2 mm and 1.8 mm. At the needle tip or in a working region of the needle, the plurality of needles have a diameter which is preferably at a maximum between 0.3 mm and 1 mm, more preferably between 0.4 mm and 0.6 mm. The term working region of the needles is used to refer to the region which penetrates into the textile fabric structure or between the support device and holding-down device. If the needles in the working region have a cross sectional shape which is not circular, the diameter can be determined by a circumcircle.

In an embodiment in which the pitch of the wires is 2.4 mm, the diameter of the wires is 0.8 mm and the diameter of the needles is 0.5 mm, a free space of 0.55 mm at each side of the needles with respect to the next wire thus remains. This illustrates the high risk of a contact between the needles and the wires and the relevance of the most precise possible positioning of the needles relative to the wires.

In a preferred embodiment, each wire of the plurality of wires is associated with a visual display, in particular an LED, to which the wire is connected in such an electrically conductive manner that the visual display outputs the optical signal when a needle of the plurality of needles comes into contact with the wire. This applies to all the embodiments of the needle machine which comprise a plurality of wires and the monitoring device of which is configured to output an optical signal. If a visual display is associated with each wire, a contact of a needle with a wire can be readily localized since the relevant needle is arranged along the wire, the visual display of which outputs the optical signal, and consequently, the relevant needle row can be identified. In contrast, the location of a relevant needle without such a display would be possible only with difficulty as a result of the high number and density of needles. Naturally, however, it would also be possible to associate a visual display with a group of wires in each case in order to reduce the complexity of the monitoring device and the required structural space.

The monitoring device may further be configured to maintain the output signal, in particular the optical signal, after the contact. The relevant needle row can thereby also be identified when the contact, for example, as a result of a stroke movement of the needle bar, is no longer present. The monitoring device may to this end comprise a storage device, such as a capacitor. For example, a contact can be stored by a transistor circuit which can be activated and deactivated by a control unit. It is also conceivable that, as a result of the contact and the resultant current flow, the visual display is switched in conjunction with another voltage source which maintains the optical signal. For example, an electrical contact can be maintained by the transistor circuit.

In principle, the needle machine and/or the monitoring device may comprise a control unit, such as a programmable logic controller. The control unit may then also comprise the storage device or carry out the corresponding switching, wherein the optical signal is maintained with the activated remanence. Furthermore, detected contacts can be transmitted in an analogue and/or digital manner to the control unit, for example, in the form of an electrical signal which is provided by the monitoring device. This enables the output of additional signals to the operator, for example, by a man/machine interface of the needle machine, and a more extensive analysis.

According to another aspect of the invention, a method for equipping a needle machine comprises the steps of: inserting a needle board into the needle machine; moving the needle board at least in a needling direction which is orientated perpendicularly to a conveying direction of the needle machine in a needling zone, wherein the plurality of needles extend through a plurality of through-openings in a holding-down device and/or in a support device of the needle machine; and monitoring a positioning of the plurality of needles relative to the holding-down device and/or to the support device by a monitoring device.

In this manner, a method is provided in which the positioning of the plurality of needles relative to the holding-down device and/or to the support device can be monitored, whereby, even with a high needle density, an incorrect positioning of one or more needles can be identified and overcome. An incorrect positioning of needles can, during operation of the needle machine, lead to a contact of these needles with the holding-down device and/or the support device which in turn can lead to increased wear or even needle breakage or wire breakage. The risk increases with a higher needle density. As a result of the monitoring by the monitoring device, this can be counteracted and the operational reliability can be increased.

In principle, the method can be used to equip the needle machine as described above. All the features and advantages described with reference to the needle machine therefore apply in a similar manner to the method and vice versa.

The needle board is preferably provided with a plurality of needle modules which each comprise a plurality of needles. Preferably, the plurality of needle modules are already secured to the needle board during insertion and the needle board is secured to the needle bar after insertion. In this state, the plurality of needles should be correctly positioned. Prior to the insertion of the needle board into the needle machine, the method may involve the insertion of the plurality of needle modules into the needle board. To this end, a plurality of needle modules may be inserted in the transverse direction one behind the other into a recess or a carrier of the needle board. The insertion of the needle modules into the needle board may be carried out outside the needle machine.

The movement of the needle board in the needling direction can be carried out in the context of the fitting or the equipment of the needle machine prior to the actual operation thereof. Particularly in this instance, individual or a few strokes of the needle bar may be carried out in order to check the orientation of the plurality of needles or the plurality of needle modules. It is thus possible to intervene directly and where applicable to correct the orientation before the needle machine begins operation and damage can occur.

According to another aspect of the invention, a method for operating a needle machine comprises the steps of: moving a textile fabric structure in a conveying direction through a needling zone of the needle machine, wherein the textile fabric structure is received in the needling zone between a support device and a holding-down device; consolidating the textile fabric structure by an oscillating movement of a plurality of needles at least in a needling direction which is orientated perpendicularly to a conveying direction of the needle machine in a needling zone, wherein the plurality of needles extend through a plurality of through-openings in the holding-down device and/or the support device; and monitoring a positioning of the plurality of needles relative to the holding-down device and/or to the support device by a monitoring device.

In this manner, a method is provided in which the positioning of the plurality of needles relative to the holding-down device and/or to the support device can be monitored, whereby, even with a high needle density, an incorrect positioning of one or more needles can be identified and overcome. An incorrect positioning of needles can, during operation of the needle machine, lead to a contact of these needles with the holding-down device and/or with the support device which in turn can result in increased wear or even needle breakage or wire breakage. The risk increases with a higher needle density. As a result of the monitoring by the monitoring device, this can be counteracted and the operational reliability can be increased.

In principle, the method can be used for operating the needle machine as described above. All the features and advantages described with regard to the needle machine therefore apply similarly to the method and vice versa.

In both methods, the monitoring of the positioning of the plurality of needles preferably involves detecting a contact between a needle of the plurality of needles and the holding-down device and/or the support device. For example, in the event of contact, a power circuit is closed. The methods can then further involve the output of the optical and/or acoustic and/or electrical signal, as described with reference to the electrical monitoring device. The electrical signal may be an analogue or digital signal, which can be transmitted, for example, to the control unit.

DETAILED DESCRIPTION OF SPECIFIC EMBODIMENTS

Figure 1:
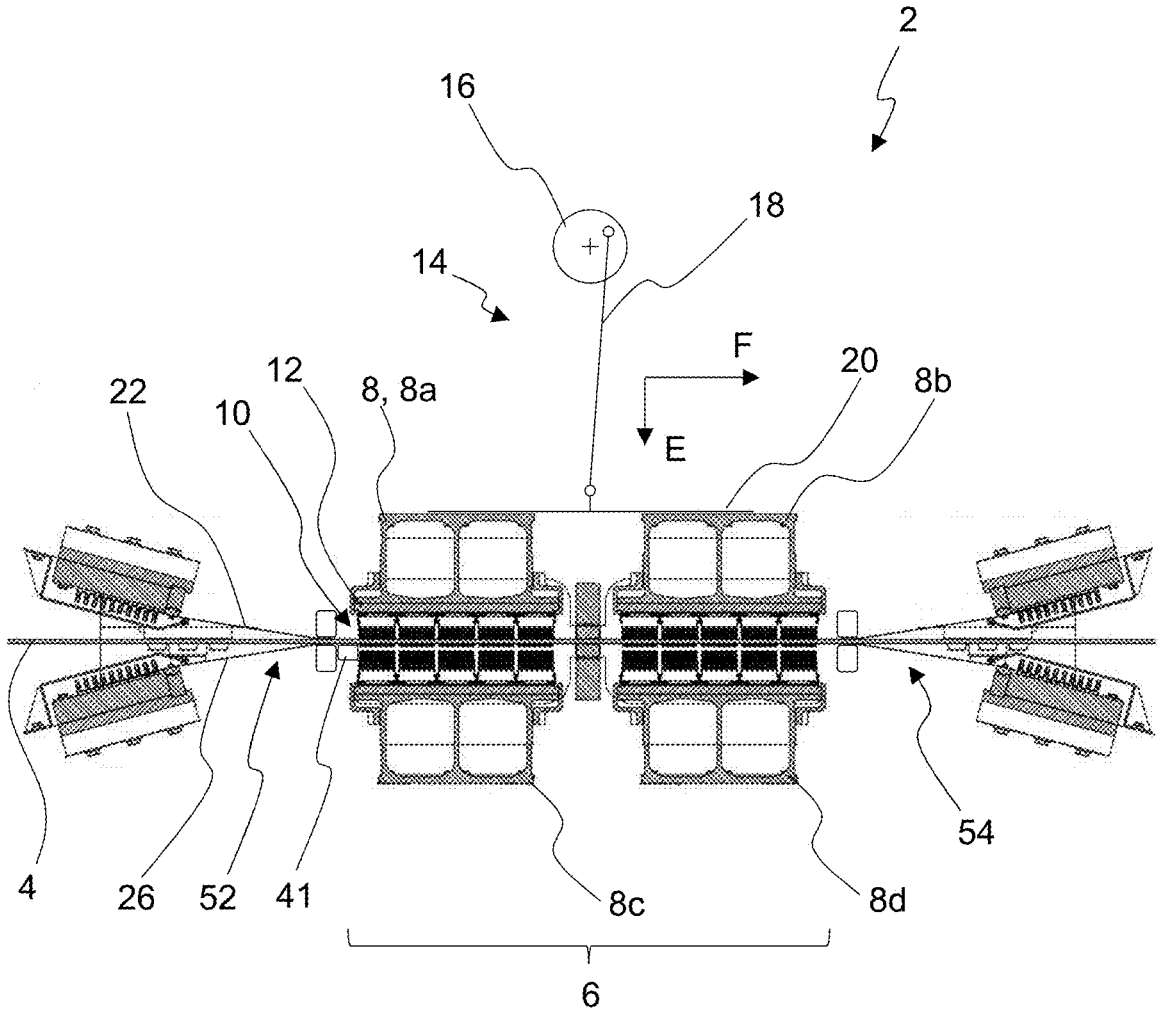
FIG. 1 is a schematic side view of the significant components of a needle machine.

In FIG. 1, the significant components of a needle machine 2 are schematically illustrated in a side view. In principle, in the needle machine 2 a textile fabric structure 4, such as a fibrous web, a non-woven fabric, a web or mat, is conveyed in a conveying direction F through a needling zone 6 in which the textile fabric structure 4 is compacted. To this end, the needle machine 4 comprises at least one needle bar 8 having a plurality of needles 10. For example, a needle board 12 may be provided with the plurality of needles 10 and secured to the needle bar 8. Optionally, the needle machine 2, as illustrated, may comprise a plurality of needle bars 8*a*, 8*b*, 8*c*, 8*d*. The needle bars 8*a* and 8*b* are arranged one behind the other in the conveying direction F. In addition, in the embodiment illustrated, this may involve a double needle machine in which the needling is also carried out from below by the needle bars 8*c* and 8*d* which are again arranged one behind the other in the conveying direction F. The basic structure of the needle machines 2 and possible variations thereof are known to the person skilled in the art.

In order to compact the textile fabric structure 4, the plurality of needles 10 is introduced at a high frequency at least parallel with a needling direction E into the textile fabric structure 4 and removed from it again. To this end, the needle bar 8 is moved in known manner by a drive apparatus 14. The drive apparatus 14 may comprise a drive shaft 16 on which a connection rod is eccentrically supported. The connection rod 18 in turn is connected to the needle bar 8, preferably connected in an articulated manner. If a plurality of needle bars 8*a*, 8*b* are provided, these may be connected by a bridge 20 to which the connection rod 18 is connected.

As a result of a corresponding formation of the drive apparatus 14 and/or guiding of the needle bar arrangement 8, 20, a movement path of the plurality of needles 10 during the stroke movement of the needle bar 8 can be adjusted. For example, the needles 10 can be moved up and down exclusively parallel with the needling direction E. However, it is also possible for this movement to be superimposed with a movement component parallel with the conveying direction F so that the needles 10 carry out an elliptical or circular movement. In particular, the needles 10 then move in the conveying direction F while they are engaged with the textile fabric structure 4. Various construction types of the needle machines which achieve the different movement types of the needles are known to the person skilled in the art and the present invention is not limited to a specific embodiment of these construction types.

In order to enable the penetration of the plurality of needles 10 into the textile fabric structure 4 and at the same time to prevent significant quantities of fibers from being pulled from the textile fabric structure 4 when the needles 10 are pulled out of the fabric structure 4 or the entire textile fabric structure from being raised, the needle machine 2 comprises a holding-down device 22 for holding down the textile fabric structure 4 in the needling zone 6. The holding-down device 22 has through-openings 24 (see FIG. 2) through which the needles 10 can extend. A support device 26 for supporting the textile fabric structure 4 in the needling zone 6 may also have through-openings 28 for the needles 10, for example, when the needles 10 of the upper needle bars 8*a*, 8*b* fully penetrate through the textile fabric structure 4 or in double needle machines.

Figure 2:
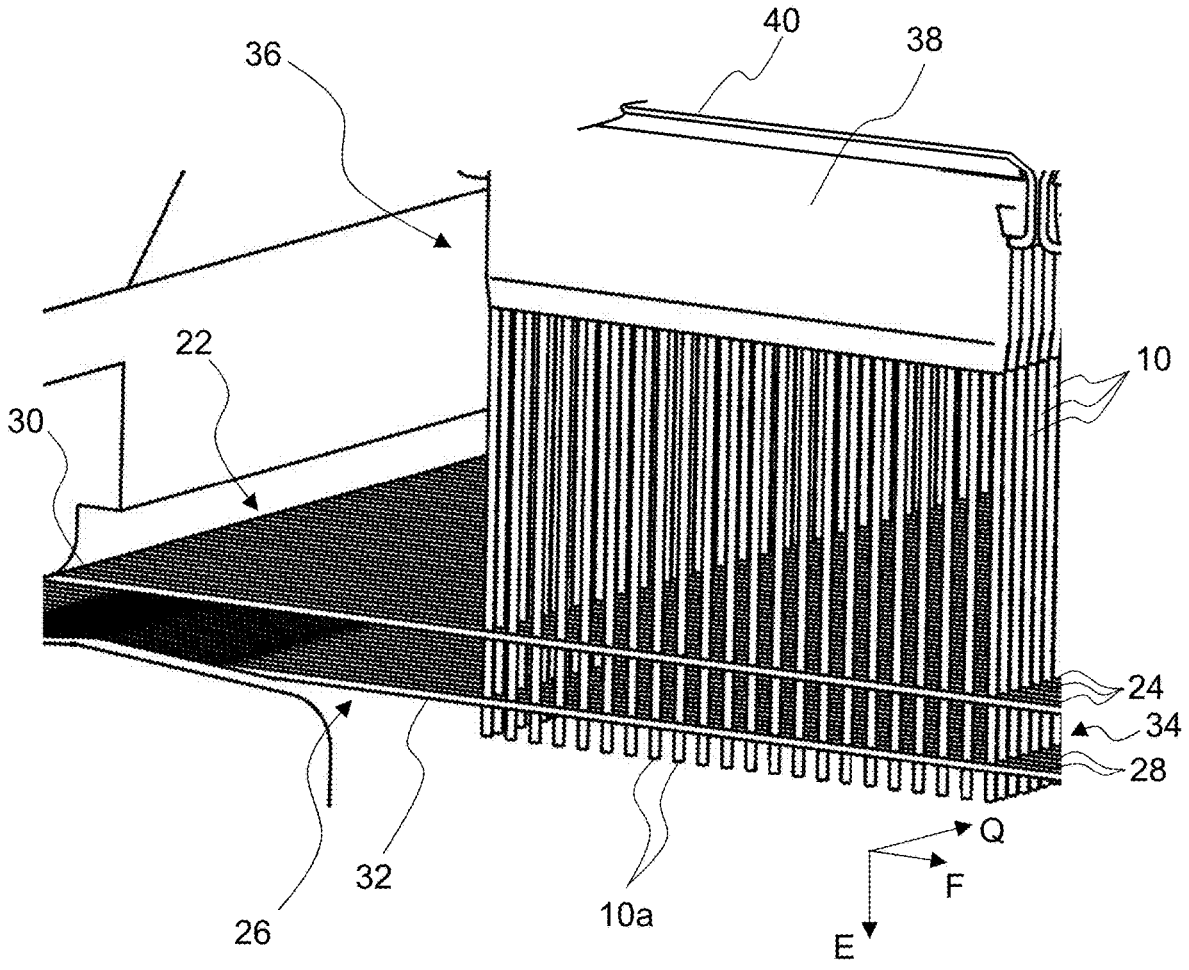
FIG. 2 is a perspective cut-out of the needling zone of the needle machine according to FIG. 1.

The holding-down device 22 and the support device 26 are described in greater detail with reference to FIG. 2 which shows a cut-out of the needling zone 6 in a detailed view. In principle, the holding-down device 22 and the support device 26 can be in the form of a holding-down plate or stitching plate having through-openings 24, 28 in the form of round or slot-like recesses, as generally known. In the embodiment illustrated, the holding-down device 22 comprises a plurality of upper wires 30 and the support device 26 comprises a plurality of lower wires 32. The plurality of upper wires 30 is in the needling zone 6 preferably arranged in a first plane and the plurality of lower wires 32 is in the needling zone 6 preferably arranged in a second plane which is orientated parallel with and with spacing from the first plane. An intermediate space 34 is thus formed between the plurality of upper wires 30 and the plurality of lower wires 32, in which intermediate space 34 the textile fabric structure 4 is conveyed in the needling zone 6.

The plurality of wires 30, 32 are preferably orientated parallel with the conveying direction F. In a transverse direction Q, the upper wires 30 are spaced apart from each other and the lower wires 32 are spaced apart from each other. A through-opening 24, 28 for a needle 10 or a row of needles 10 is thus formed in each case between two wires 30, 32 which are adjacent in the transverse direction Q. As a result of the extent of the plurality of wires 30, 32 in the conveying direction F, the through-openings 24, 28 enable a movement of the needles 10 in the conveying direction F.

The needles 10 are preferably arranged in needle modules 36, wherein each needle module 36 has a module carrier 38 and a plurality of needles 10. The plurality of needles 10 is connected in an upper portion to the module carrier 38. The tips 10*a* of the needles 10 protrude parallel with the needling direction E from the module carrier 38. Preferably, each needle module 36 has an individual row of needles 10 but may also have a plurality of longitudinal rows of needles 10. The plurality of needles 10 of all the needle modules 36 then form the plurality of needles 10 on the needle bar 8.

The needle modules 36 may in turn be received in carriers 40 of a needle board 12. Preferably in this instance, a plurality of needle modules 36 are arranged one behind the other in the transverse direction Q so that the rows of needles 10 are orientated in the conveying direction F. The needle modules 36 may be able to be inserted into the carrier 40 in the transverse direction Q and be able to be displaced there relative to each other for orientation with respect to the holding-down device 22 and to the support device 26. Prior to operation of the needle machine 2, the needle modules 36 are secured in the carriers 40. Each needle board 12 may have a plurality of needle module rows in carriers 40 which are arranged one behind the other in the conveying direction F, as shown in FIG. 1.

The needle machine 2 further comprises a monitoring device 41, 42 which is configured to monitor the positioning of the plurality of needles 10 relative to the holding-down device 22 and/or to the support device 26. The monitoring device 41 may, for example, be an optical monitoring device 41, which is configured to visually monitor the positioning of the plurality of needles 10 in the needling zone 6, as indicated in FIG. 1. To this end, the monitoring device 41 may comprise a camera, a laser, a photoelectric barrier or the like. Preferably, however, the monitoring device 42 may be in the form of an electrical monitoring device 42 and in particular configured to detect a contact between a needle 10 of the plurality of needles 10 and the holding-down device 22 and/or the support device 26.

Figure 3A:
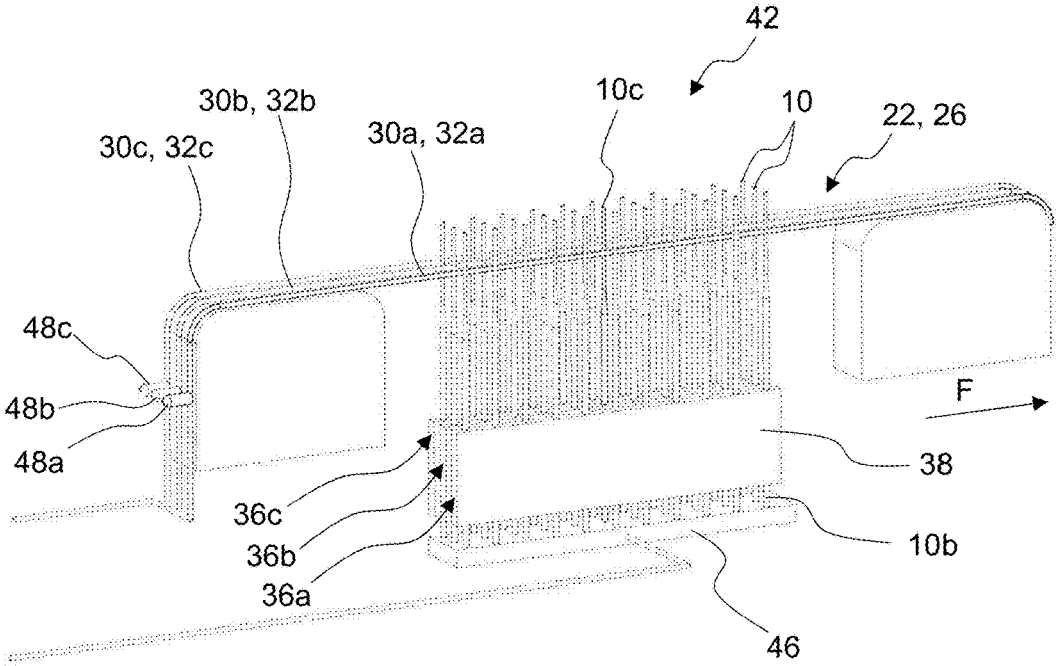
FIG. 3*a* is a schematic, perspective view of a first embodiment of a monitoring device of the needle machine according to FIGS. 1 and 2.

The electrical monitoring device 42 is described below by way of example with reference to a first embodiment according to FIGS. 3*a*, 3*b* and with reference to a second embodiment according to FIGS. 4*a*, 4*b*. In FIGS. 3*a* and 4*a*, for the sake of clarity in place of the above-described structure of the needle machine 2 in the needling zone 6 only a few wires 30, 32 and a few needle modules 36 are illustrated. The principle explained thereby can be scaled as desired. Of course, the features and advantages described can also be transferred to embodiments of the needle machine 2, in which the holding-down device 22 and the support device 26 are not formed by wires 30, 32.

Figure 3B:
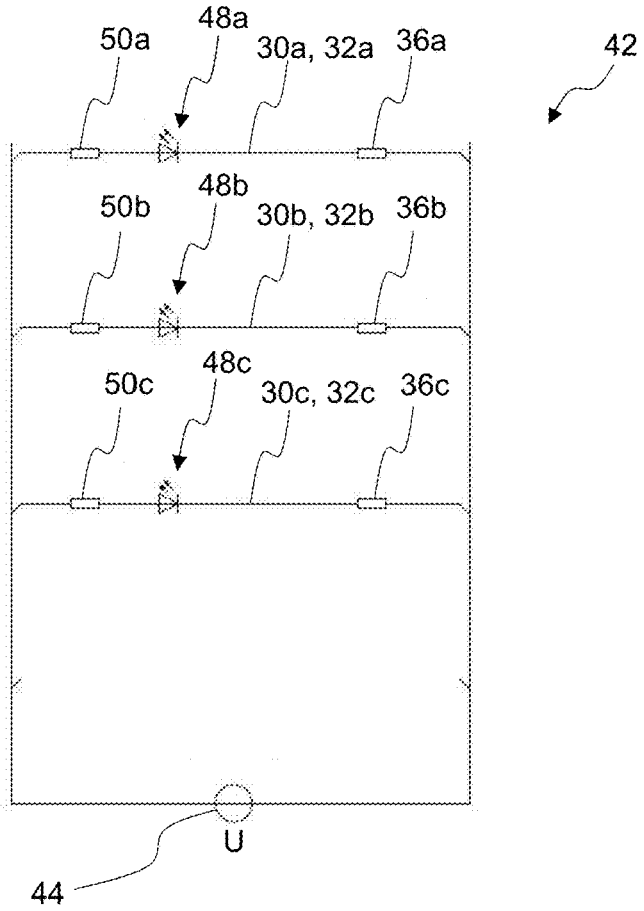
FIG. 3*b* is a circuit diagram of the monitoring device according to FIG. 3*a*.
Figure 4A:
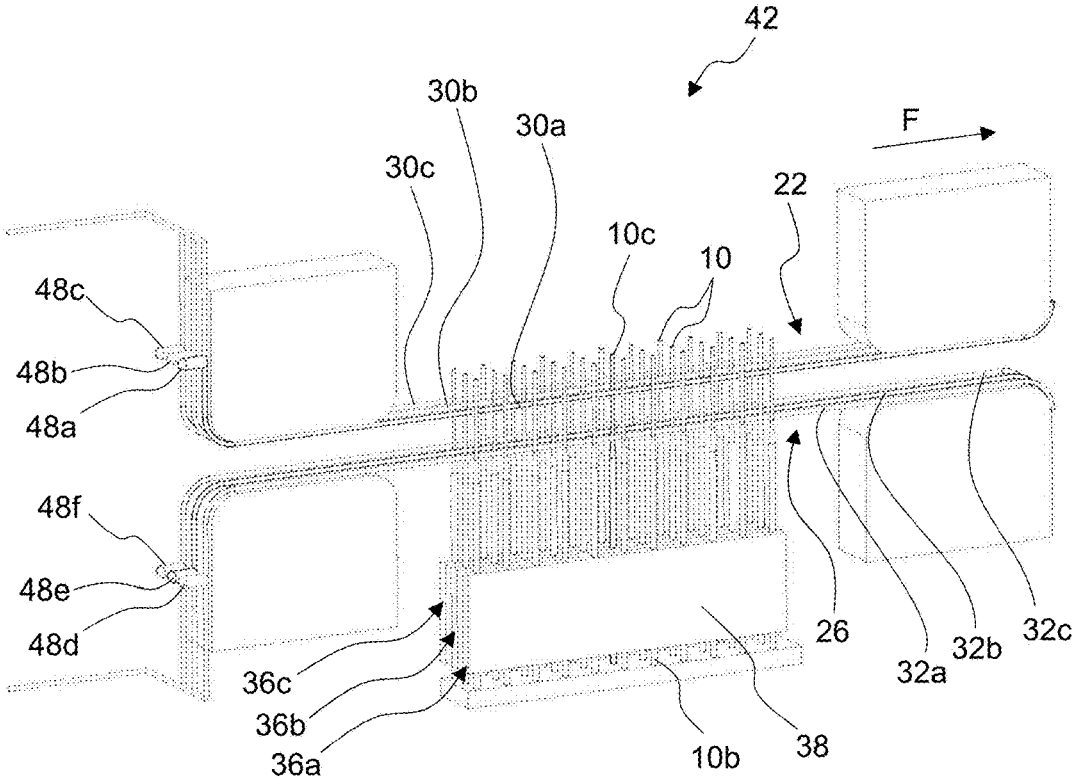
FIG. 4*a* is a schematic, perspective view of a second embodiment of a monitoring device of the needle machine according to FIGS. 1 and 2.

The arrangement illustrated in FIGS. 3*a* and 3*b* can be used equally well on the holding-down device 22 and the support device 26. According to the first embodiment, each needle 10 of the plurality of needles 10 is connected to a voltage source 44 in an electrically conductive manner. In addition, the holding-down device 22 or the support device 26 is connected to the voltage source 44 in an electrically conductive manner. If a needle 10 of the plurality of needles 10 contacts the holding-down device 22 or support device 26, the power circuit is closed and an electrical current flows.

More specifically, each wire 30*a*, 30*b* 30*c* of the holding-down device 22 or each wire 32*a*, 32*b*, 32*c* of the support device 26 is preferably connected to the voltage source 44. In addition, each needle module 36*a*, 36*b*, 36*c* is connected to the voltage source 44. The heads 10*b* of the needles 10 may be exposed or protrude from the module carrier 38 and contact an electrically conductive contact element 46 which in turn is connected to the voltage source 44. The contact element 46 may, for example, be inserted in the carriers 40 on the needle board 12 or be formed integrally therewith. Preferably, for each carrier 40 and consequently for each row of needle modules 36 at least one contact element 46 is provided. In the illustrated case, the needle 10*c* touches the wire 30*a*, 32*a*, for example, since it is bent, and thereby closes the power circuit.

In principle, the monitoring device 41, 42 may be configured, in the event of contact of a needle 10 with the holding-down device 22 and/or the support device 26, to output an optical signal and/or an acoustic signal. To this end, the monitoring device 41, 42 may comprise a visual display 48, for example, in the form of an LED. In the embodiments illustrated, an LED 48*a*, 48*b*, 48*c* is associated with each wire 30*a*, 30*b*, 30*c* or 32*a*, 32*b*, 32*c*. If the power circuit is closed at a wire, in this instance at the wire 30*a*, 32*a*, the corresponding LED 48*a* illuminates and thereby outputs the optical signal. The operator of the needle machine 2 can thereby determine at which wire there is a contact with respect to one or more needles 10, for example, as a result of a defective needle 10 or incorrect orientation of the needles 10 and can thus locate the corresponding needle or needles.

In FIG. 3*b*, the needle modules 36*a*, 36*b*, 36*c* are illustrated as a compensating resistor. According to the circuit diagram in FIG. 3*b*, a protective resistor 50*a*, 50*b*, 50*c* may further be associated with each LED 48*a*, 48*b*, 48*c*.

According to the second embodiment, the holding-down device 22 and the support device 26 are each connected to the voltage source 44. The plurality of needles 10 in this embodiment does not have to be connected separately to the voltage source 44. The heads 10*b* of the needles 10 can therefore also be completely received in the module carrier 38. If a needle 10 of the plurality of needles 10 contacts the holding-down device 22 and the support device 26, it thereby closes the power circuit and an electrical current flows.

More specifically, each wire 30*a*, 30*b*, 30*c* of the plurality of wires 30 of the holding-down device 22 and each wire 32*a*, 32*b*, 32*c* of the plurality of wires 32 of the support device 26 is preferably connected to the voltage source 44. In the case illustrated, the needle 10*c* touches, for example, the wire 30*c* and the wire 32*c* and thereby closes the power circuit.

In the second embodiment, a visual display 48 may also be provided, wherein in this instance an LED 48*a*, 48*b*, 48*c* is associated with each upper wire 30*a*, 30*b*, 30*c* of the holding-down device 22 and an LED 48*d*, 48*e*, 48*f* is associated with each lower wire 32*a*, 32*b*, 32*c* of the support device 26. The LEDs 48*c* and 48*f* would therefore output an optical signal. It would also be conceivable for a needle 10*c* to be bent in such a manner or for a needle module 36 to be incorrectly orientated in such a manner that the needle 10*c* contacts the wire 30*c* of the holding-down device 22 and the wire 32*b* of the support device 26. This would also be noticed by the operator as a result of the LEDs 48*c* and 48*e* then illuminating.

Figure 4B:
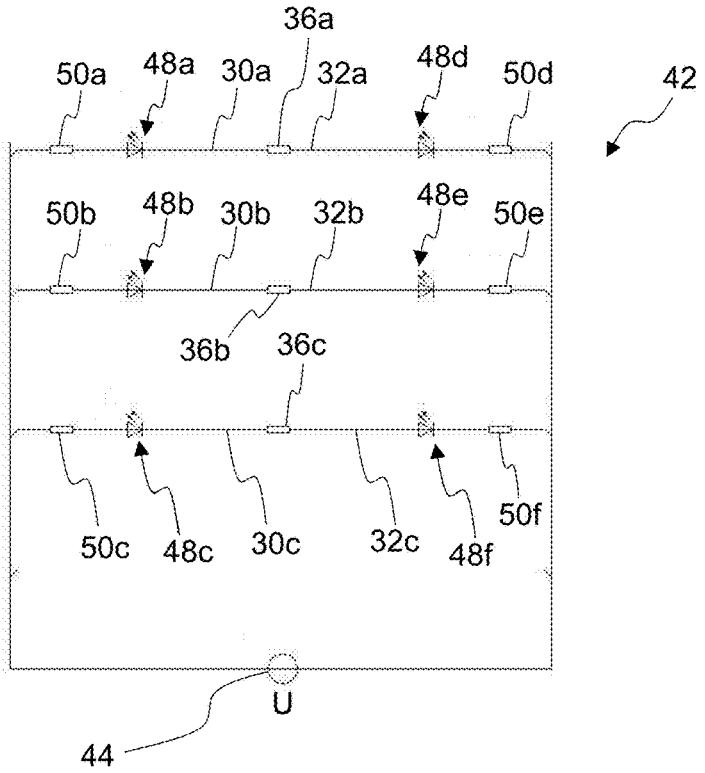
FIG. 4*b* is a circuit diagram of the monitoring device according to FIG. 4*a*.

In the circuit diagram according to FIG. 4*b*, the needle modules 36*a*, 36*b*, 36*c* are illustrated by compensating resistors, on both sides of which the upper wires 30 or lower wires 32 extend. A protective resistor 50*a-f* may be associated with each LED 48*a-f* in each case.

Figure 5:
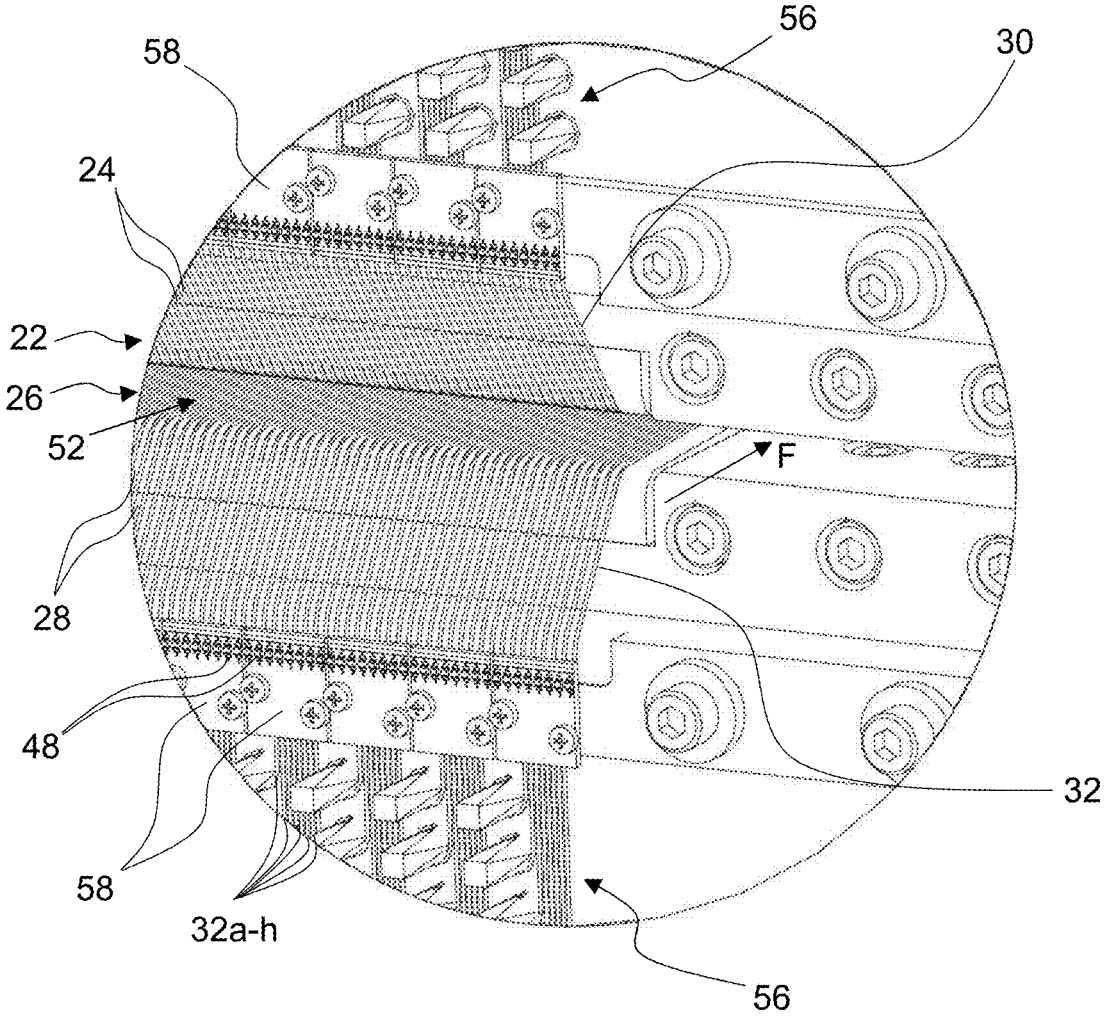
FIG. 5 shows a detailed view of a cut-out of the monitoring device.

In FIG. 5, a detailed view of the holding-down device 22 and the support device 26 is shown in the region of an inlet 52 of the textile fabric structure 4 (see FIG. 1). In the same manner, the needle machine 2 could be formed at an outlet 54. At the inlet 52 and at the outlet 54, the plurality of wires 30 of the holding-down device 22 are redirected in an upward direction and the plurality of wires 32 of the support device 26 are redirected in a downward direction. In the region of the inlet 52, the plurality of upper wires 30 and the plurality of lower wires 32 move increasingly close to each other in the conveying direction F in order to form the intermediate space 34 for receiving the textile fabric structure 4. The plurality of wires 30, 32 can be guided substantially freely outside the inlet 52 and the outlet 54 so that there is more structural space available, for example, for a clamping device 56 of the wires 30, 32.

The monitoring device 41, 42 may comprise one or more printed circuit boards 58 of which one is described by way of example. As illustrated, a plurality of wires 32*a-h* of the support device 26 may extend to form a printed circuit board 58 and be connected at that location to an LED 48 in an electrically conductive manner in each case. In addition, the voltage source 44 may be connected to the wires 32*a-h* by the printed circuit board 58. It is also conceivable for an additional electronic control and/or evaluation unit to be arranged on the printed circuit board 58, for example, in order to count the number of contacts of needles 10 with a wire 32*a-h* which is associated with the respective printed circuit board 58 or in order, after contact of a needle 10 with one of the wires 32*a-h*, to maintain the optical signal of the respective LED 48 even when the contact does not continue.

The invention claimed is:

1. A needle machine for needling a textile fabric structure, the needle machine comprising:

a needle bar having a plurality of needles for consolidating the textile fabric structure in a needling zone of the needle machine;

a holding-down device for holding-down the textile fabric structure in the needling zone, wherein the holding-down device has a plurality of through-openings for the plurality of needles;

a support device for supporting the textile fabric structure in the needling zone, wherein the support device has a plurality of through-openings for the plurality of needles; and a monitoring device configured to monitor the positioning of the plurality of needles relative to the holding-down device and/or to the support device.

2. The needle machine according to claim 1 wherein the monitoring device is configured to detect a contact between a needle of the plurality of needles and the holding-down device and/or the support device.

3. The needle machine according to claim 2 wherein the monitoring device is configured to output an optical, acoustic and/or electrical signal, when a contact is detected.

4. The needle machine according to claim 1 wherein the monitoring device is an electrical monitoring device.

5. The needle machine according to claim 4 wherein the electrical monitoring device comprises a resistance detection device, a conductive detection device, an inductive detection device or a capacitive detection device.

6. The needle machine according to claim 4 wherein the monitoring device is configured in a way such that, when a needle of the plurality of needles comes into contact with the holding-down device and/or with the support device, a power circuit comprising a voltage source is closed.

7. The needle machine according to claim 6 wherein each needle of the plurality of needles is connected to an earth or the voltage source in an electrically conductive manner.

8. The needle machine according to claim 7 wherein a group of needles of the plurality of needles is connected in each case to a common, electrically conductive contact element which is connected to the earth or the voltage source in an electrically conductive manner.

9. The needle machine according to claim 7 wherein the holding-down device and the support device are constructed in an electrically conductive manner and are connected in each case to the voltage source in an electrically conductive manner.

10. The needle machine according to claim 1 wherein the monitoring device is an optical monitoring device.

11. The needle machine according to claim 1 wherein the holding-down device and/or the support device in each case comprise a plurality of wires for holding down or supporting the textile fabric structure, wherein between the wires of the plurality of wires the through-openings for the plurality of needles are formed.

12. The needle machine according to claim 11 wherein a visual display is associated with each wire of the plurality of wires, wherein the wire is connected in an electrically conductive manner to the visual display such that the visual display outputs an optical signal when a needle of the plurality of needles comes into contact with the wire.

13. The needle machine according to claim 12 wherein the monitoring device is configured such that the visual display maintains the optical signal after the contact.

14. A method for equipping a needle machine comprising the steps of inserting a needle board into the needle machine;

moving the needle board at least in a needling direction which is orientated perpendicularly to a conveying direction of the needle machine in a needling zone, wherein the plurality of needles extend through a plurality of through-openings in a holding-down device and/or a plurality of through-openings in a support device of the needle machine; and monitoring a positioning of the plurality of needles relative to the holding-down device and/or to the support device by a monitoring device.

15. The method for equipping a needle machine according to claim 14 wherein the monitoring includes detecting a contact between a needle of the plurality of needles and the holding-down device and/or the support device, and wherein the method further comprises the step of outputting an acoustic, optical and/or electrical signal by the monitoring device when the monitoring device detects a contact.

16. A method for operating a needle machine comprising the steps of:

moving a textile fabric structure in a conveying direction through a needling zone of the needle machine, whereon the textile fabric structure is received in the needling zone between a support device and a holding-down device;

consolidating the textile fabric structure by an oscillating movement of a plurality of needles at least in a needling direction which is orientated perpendicularly to the conveying direction in the needling zone, wherein the plurality of needles extend through a plurality of through-openings in the holding-down device and/or in the support device;

monitoring a positioning of the plurality of needles relative to the holding-down device and/or to the support device by a monitoring device.

17. The method for operating a needle machine according to claim 16 wherein the monitoring includes detecting a contact between a needle of the plurality of needles and the holding-down device and/or the support device, and wherein the method further comprises the step of outputting an acoustic, optical and/or electrical signal by the monitoring device when the monitoring device detects a contact.

* * * * *